United States Patent [19]

Funston

[11] B 3,981,152

[45] Sept. 21, 1976

[54] QUICK EGRESS FROM DEEP UNDERGROUND

[75] Inventor: Nelson Edward Funston, Mercer Island, Wash.

[73] Assignee: The Boeing Company, Seattle, Wash.

[22] Filed: Feb. 28, 1975

[21] Appl. No.: 554,283

[44] Published under the second Trial Voluntary Protest Program on January 27, 1976 as document No. B 554,283.

[52] U.S. Cl. ..... 61/.5; 61/40; 89/1.809

[51] Int. Cl.[2] ..... B65G 5/00; B65G 53/00

[58] Field of Search ..... 61/.5, 40, 41, 46; 89/1.809, 1.81

[56] References Cited

UNITED STATES PATENTS 3,608,636 9/1971 Dixon ..... 61/.5 X

FOREIGN PATENTS OR APPLICATIONS 1,059,494 2/1967 United Kingdom ..... 61/.5

*Primary Examiner*—Jacob Shapiro
*Attorney, Agent, or Firm*—Donald A. Streck

[57] ABSTRACT

A method of storage deep underground in a protected environment capable of withstanding nuclear blasts while allowing access for maintenance and rapid egress when necessary — even after exposure to severe environments due to an explosion at or near the surface of the earth. To accomplish these ends, the object or objects to be stored are contained in a closed container of positive buoyancy in quicksand. A shaft is excavated in the earth and filled with sand. The water content of the sand backfill is controlled and maintained at that percentage of saturation which will provide the best compromise between rapidity and ease of container egress on one hand and resistance to hostile surface environments on the other. Means for the introduction of additional water at the bottom of the sand-filled shaft are provided. When the sand column is fluidized by the injection of water at the bottom thereof, quicksand is formed in the shaft and the container can be drawn to the bottom by a tether line. When water injection is stopped, the sand returns to its normal solid condition and provides a protective layer for the buried container while restraining it in its deep buried position. The sand, in its normal tightly packed solid condition also acts to preserve the egress path to the surface by preventing the entry of dislodged earth material in the attack environment. To access the container for maintenance or for use of the contents, the shaft is again fluidized allowing the container to float to the surface.

9 Claims, 4 Drawing Figures

QUICK EGRESS FROM DEEP UNDERGROUND

BACKGROUND OF THE INVENTION

1. Field of the Invention

The present invention relates to explosion proof storage facilities and more particularly to methods for storing and recovering material likely to be exposed to nuclear explosions.

2. Description of the Prior Art

There is currently no recognized method for constructing a facility which can be protected against the effects of a direct hit by a nuclear weapon and later be made available for use at the earth's surface. It is known, however, that the effects of a nuclear weapon attack can be survived if the facility being protected is buried deep enough in the earth. Given a defined nuclear threat, it is possible to go deep enough to survive that threat. The reason no previous system has been successful is that after surviving a nuclear attack, there has been no viable way to get back to the earth's surface.

Therefore, it is the object of the present invention to provide a way to construct accessable storage far enough below the earth's surface to withstand the effects of a direct nuclear attack while allowing rapid return of the storage facility to the earth's surface after the nuclear attack.

DESCRIPTION OF THE PREFERRED EMBODIMENT

In the accompanying text and drawings of this specification the present invention is shown being used to store and retrieve an ICBM. While this is the primary motivation leading to the discovery of the present invention, it is to be understood that the technique will work equally well on a smaller scale for the storage and protection of any valuable object. Examples are: papers and works of art or on a larger scale for the protection of groups of individuals by providing life support systems within the sealed container.

Figure 1:
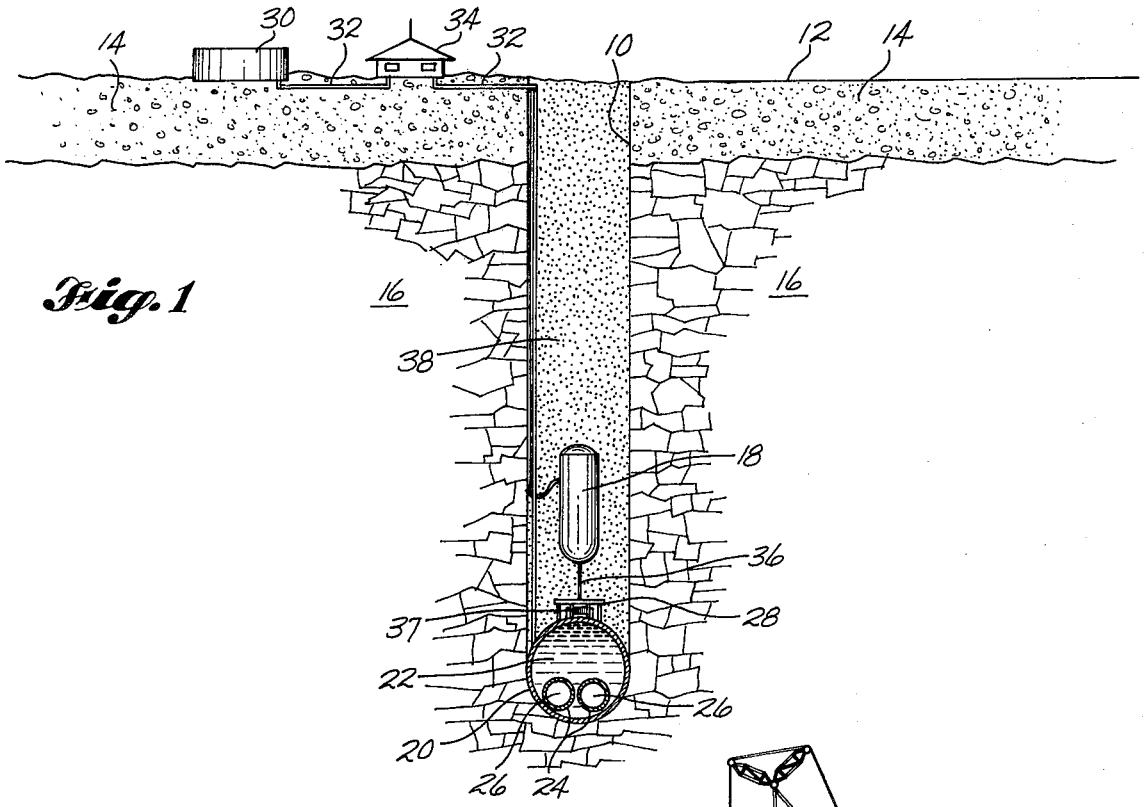
FIG. 1 shows a cross section through a portion of the earth disclosing the practicing of the present invention with the storage facility in its buried position.
Figure 2:
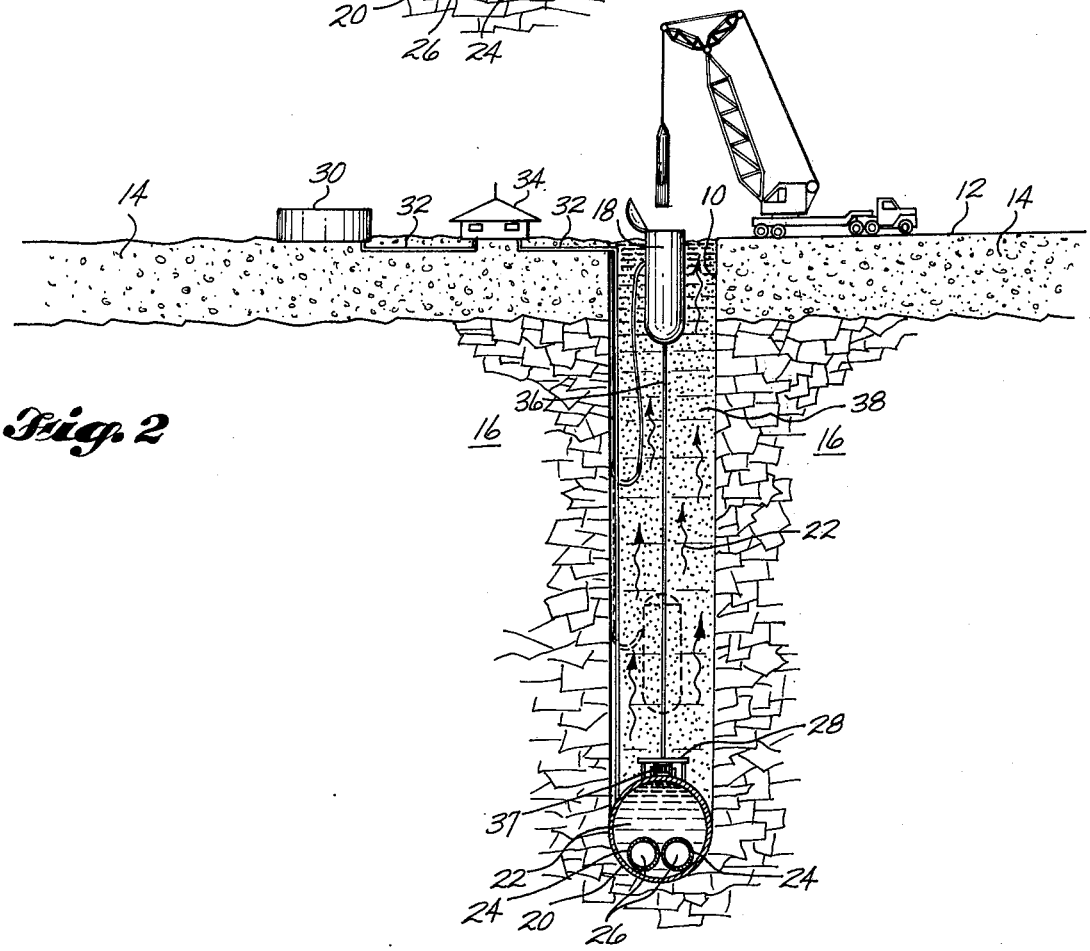
FIG. 2 shows the method of access to the storage facility of FIG. 1 under normal maintenance conditions.
Figure 3:
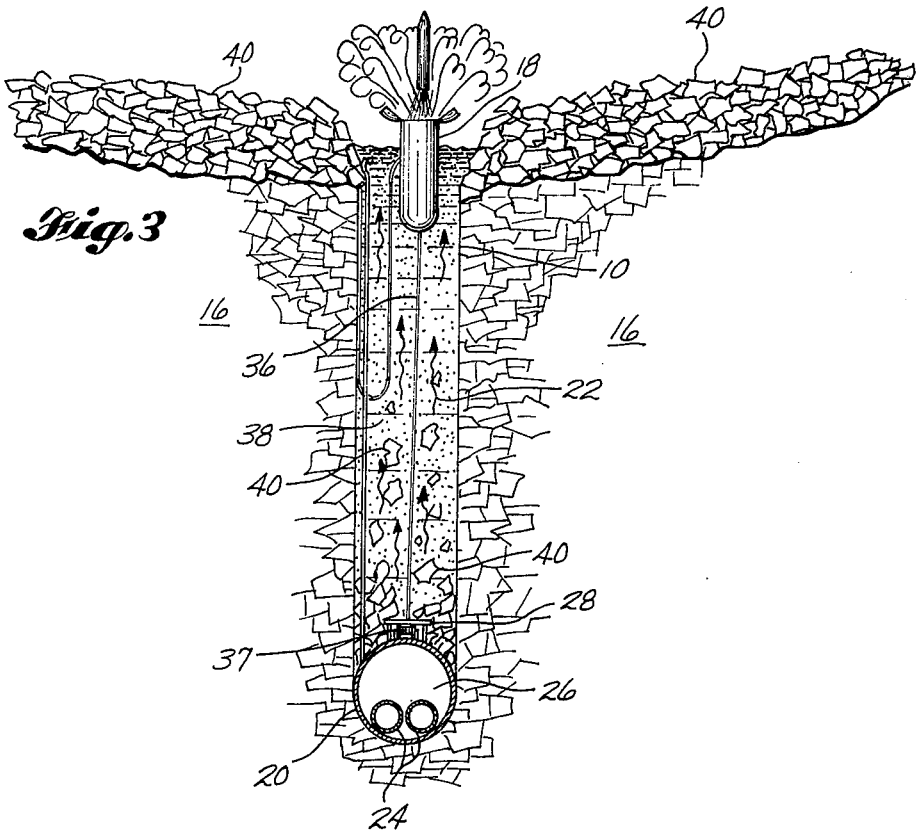
FIG. 3 shows the method of access to the storage facility of FIG. 1 following a nuclear attack.
Figure 4:
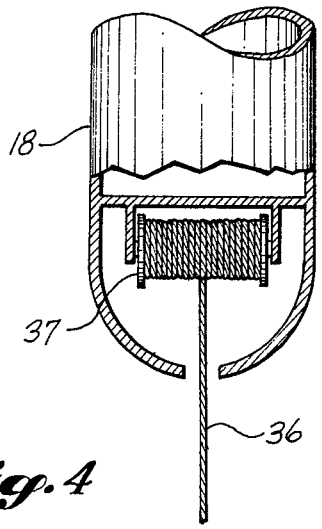
FIG. 4 shows the alternate method of providing the required winding means within the storage container.

Referring first to FIG. 1, the present invention is shown in its static state with the facility in its stored safe position. A shaft 10 is first excavated into the earth 12 through the soil layer 14 and into the rock layer 16 to a depth sufficient to substantially guarantee survival from weapon effects. This distance is generally in excess of five-hundred feet. The diameter of the shaft 10 must be only large enough to allow a storage container 18 to rise in the shaft 10 while allowing for the passage thereby in a downward direction of debris (not shown) sinking in the shaft 10 and negotiating any bends and discontinuities in the shaft 10 following a nuclear attack. A water tank 20 for the storage of fluidizing water 22 is placed at the bottom of shaft 10 and secured in that position. The water tank 20 is provided with inner tanks 24 for the storage of compressed gas 26 communicating with the water tank 20 so that compressed gas 26 can be released into water tank 20 causing fluidizing water 22 to be forced out manifold 28. In alternate embodiments inner tanks 24 could be placed outside water tank 20 and/or contain gas generators or motor operated pumps to effect the discharge of fluidizing water 22 to be forced out manifold 28. Water tank 20 is further connected to surface water supply 30 by umbilical connector 32 controlled by surface support structure 34. The storage container 18 is anchored to the bottom of the shaft 10 by tether 36. Winding means 37 are provided communicating through umbilical connector 32 and tether 36 to surface support structure 34 for letting out or taking in tether 36 so that storage container 18 can rise to or be pulled down from the surface of the earth 12. While winding means 37 is shown in FIGS. 1, 2 and 3 as being attached to the water tank 20, it can equally well be placed in the bottom of the storage container 18 as in FIG. 4. This latter method would be particularly suited to a storage container for safeguarding personnel wherein a handcrank (not shown) could be provided for emergency operation. Shaft 10 is first filled with saturated compacted fine sand 38 prior to initial placement of storage container 18 into shaft 10.

Normal access to the storage container 18 is provided by the method shown in FIG. 2. Fluidizing water 22 is pumped under the control of surface support structure 34 from surface water supply 30 through umbilical connector 32 to water tank 20 and thence out manifold 28. As fluidizing water 22 rises in shaft 10, the sand 38 is fluidized to a "quicksand" condition having a density of approximately 115 lbs/ft$^3$. The storage container 18 is constructed and filled so as to have a loaded density of 100 lbs/ft$^3$ or less in order to maintain a positive buoyancy. If winding means 37 is activated to allow the tether 36 to unwind, the storage container 18 will float to the top where the contents can be accessed. Upon reclosing storage container 18, winding means 37 can rewind tether 36 to draw the storage container 18 to the bottom. Upon stopping the flow of fluidizing water 22, sand 38 in shaft 10 will again assume a compacted, non-fluidized state as sand 38 settles and fluidizing water 22 collects at the top of shaft 10. The top portion of shaft 10 is then refilled with sand 38 which will have overflowed during the fluidization process.

In the event of a nuclear attack, surface support structure 34 and surface water supply 30 will, in all probability, be destroyed along with all external power sources, leaving the configuration of FIG. 3. Rock and debris 40 will cover shaft 10. Means responsive to external signals, timed, or responsive to signals from personnel or equipment in storage container 18 will have to be provided as part of winding means 37 to activate the post nuclear recovery of storage container 18. At the appropriate time, compressed gas 26 is released from inner tanks 24 into water tank 20 causing fluidizing water 22 to exit from manifold 28 to fluidize sand 38. Simultaneously, tether 36 is unwound or disconnected as by an explosive squib (not shown) to allow storage container 18 to rise freely to the surface. As sand 38 becomes fluidized, the rock and debris 40 over the top of shaft 10, having a density of 140 to 160 lbs/ft$^3$, will sink and pass by the rising storage container 18. Upon arriving at the surface, storage container 18 can be opened to recover its contents, or, open automatically to fire its contents as shown in FIG. 3.

The invention described herein has been tested on a subscale laboratory basis and was found to work as anticipated. Quicksand has a fluid density of about 115 lbs/ft$^3$ and an apparent viscosity which decreases as the rate of water flow is increased. The capsule was found to float nicely upward and pass the rock and rubble which were sinking without any problem.

Having thus described my invention, what is claimed is:

1. A method for storing and accessing a container in an environment highly resistive to damage from nuclear attack or other explosive conditions comprising the steps of:

a. excavating a shaft into the earth, said shaft being of a diameter sufficient to allow debris descending in said shaft to bypass a container rising in said shaft and also sufficient to allow said container to negotiate any bends and discontinuities in said shaft, said shaft being of a depth sufficient to provide protection from nuclear blasts for objects buried at said depth;

b. placing first means for the storage of water at the bottom of said shaft, saif first means for the storage of water having means for directing water into said shaft substantially at the bottom thereof;

c. placing pressure means at the bottom of said shaft, said pressure means being in communication with said first means for the storage of water causing water contained in said first means for the storage of water to be discharged through said means for directing water into said shaft when said pressure means is activated;

d. filling said first means for the storage of water with water;

e. affixing a storage container to the bottom of said shaft by tether means, said tether means being able to allow said storage container to rise to the top of said shaft and further being able to draw said storage container to the bottom of said shaft, said storage container being of a density when loaded less than that of quicksand;

f. filling said shaft with saturated sand;

g. using said water contained in said first means for the storage of water to fluidize said saturated sand into quicksand to access said storage container by allowing said storage container to float up to the surface of said quicksand and drawing said storage container down against the buoyant force of said quicksand with said tether means; and, h. allowing said quicksand to de-fluidize and return to the state of being saturated, compacted sand with said storage container at the bottom of said shaft to store said storage container in a nuclear explosion proof environment.

2. A method for storing and accessing a container in an environment highly resistive to damage from nuclear attack as claimed in claim 1 wherein:

said pressure means comprises a tank containing compressed gas, said tank having valve means responsive to a control signal allowing the flow of compressed gas to said first means for the storage of water to be stopped and started from an external location.

3. A method for storing and accessing a container in an environment highly resistive to damage from nuclear attack as claimed in claim 2 wherein:

said tank is disposed within said first means for the storage of water.

4. A method for storing and accessing a container in an environment highly resistive to damage from nuclear attack as claimed in claim 1 wherein additionally:

a. said first means for the storage of water at the bottom of said shaft is connected to second means for storage of water at the earth's surface, said second means for storage of water at the earth's surface being used to fill said first means for storage of water at the bottom of said shaft and to fluidize said sand for normal access to said storage container;

b. said means for directing water into said shaft substantially at the bottom thereof is through a manifold; and c. said tether means is responsive to external control signals.

5. A method for storing and accessing a container in an environment highly resistive to damage from nuclear attack as claimed in claim 1 wherein:

said pressure means comprises a protective enclosure containing means for generating gas.

6. A method for storing and accessing a container in an environment highly resistive to damage from nuclear attack as claimed claim 1 wherein:

said pressure means comprises motorized pumping means.

7. A method for storing and accessing a container in an environment highly resistive to damage from nuclear attack comprising the steps of:

a. excavating a shaft substantially normal to the earth's surface into the earth a distance sufficient to protect an object buried at the depth from the effects of a nuclear explosion directly above it at the earth's surface;

b. attaching a tether to the bottom of said shaft, said tether extending from the bottom of said shaft to the surface of said shaft;

c. filling said shaft with saturated sand;

d. attaching a storage container to the surface end of said tether by winding means attached to said storage container, said winding means being capable of winding said tether thereon to draw said storage container to the bottom of said shaft, said storage container being water tight when closed and having operable means for access to the interior of said storage container, said storage container further being of a positive buoyancy when filled with items of intended storage and placed in quicksand;

e. storing said storage container by injecting water into said shaft substantially at the bottom thereof to cause said saturated sand to attain a state of being quicksand and remain in said state of being quicksand;

f. activating said winding means to wind said tether and draw said storage container to the desired depth for storage;

g. ceasing the injection of water into said shaft to allow said sand to return to the state of being saturated compacted sand to complete the storage of said storage container;

h. accessing said container by injecting water into said shaft from a point below that at which said storage container is stored to cause said saturated sand to attain a state of being quicksand and remain in said state of being quicksand; and, i. allowing said storage container to float to the surface of said quicksand where the interior of said storage container can be reached by said operable means for access thereto.

8. A method for storing and accessing a container in an environment highly resistive to damage from nuclear attack as claimed in claim 7 wherein:

said step of allowing said storage container to float to the surface of said quicksand is accomplished by activating said winding means to unwind said tether.

9. A method for storing and accessing a container in an environment highly resistive to damage from nuclear attack as claimed in claim 7 wherein:

said step of allowing said storage container to float to the surface of said quicksand is accomplished by separating said tether from said storage container.

* * * * *